US012195138B2

(12) United States Patent
Eaker

(10) Patent No.: US 12,195,138 B2
(45) Date of Patent: Jan. 14, 2025

(54) BOATING ACCESSORY

(71) Applicant: Klipper Shades, Inc., Melbourne, FL (US)

(72) Inventor: James Eaker, Melbourne, FL (US)

(73) Assignee: Klipper Shades, Inc., Melbourne, FL (US)

( * ) Notice: Subject to any disclaimer, the term of this patent is extended or adjusted under 35 U.S.C. 154(b) by 0 days.

(21) Appl. No.: 18/243,690

(22) Filed: Sep. 8, 2023

(65) Prior Publication Data

US 2023/0415851 A1 Dec. 28, 2023

Related U.S. Application Data

(62) Division of application No. 17/349,376, filed on Jun. 16, 2021, now Pat. No. 11,794,858.

(51) Int. Cl.

| | |
|---|---|
| ***B63B 17/02*** | (2006.01) |
| ***B63B 21/00*** | (2006.01) |
| ***B63B 21/56*** | (2006.01) |

(52) U.S. Cl.

CPC ..... *B63B 17/02* (2013.01); *B63B 21/00* (2013.01); *B63B 21/56* (2013.01)

(58) Field of Classification Search

CPC ..... B63B 17/00; B63B 17/02; B63B 21/00; B63B 21/56

USPC ..... 114/361

See application file for complete search history.

(56) References Cited

U.S. PATENT DOCUMENTS

| | | | | |
|---|---|---|---|---|
| 7,424,862 | B1 * | 9/2008 | Wagner | B63B 17/02 114/364 |
| 11,319,031 | B1 * | 5/2022 | Perry | B63B 21/56 |
| 11,794,858 | B2 * | 10/2023 | Eaker | B63B 17/02 |

* cited by examiner

*Primary Examiner* — Lars A Olson

(74) *Attorney, Agent, or Firm* — Harvey S. Kauget; Burr & Forman LLP

(57) ABSTRACT

The Boating Accessory is a multi-use fastener designed to attach to various surfaces or objects on a boat. The Boating Accessory may include a body hingedly connected to an arm with a suction mechanism that can be used to secure a corner onto either fiberglass or window glass. The Boating Accessory may include a clip with a rounded portion that can be used to attach to most stainless handles or deck railing with a strong spring for clamping. The clip is useful in attaching to fabrics or hard roofs with a friction member at the contact point. The multi-use fastener may be used to secure a shade anywhere on a boat to immediately and effectively block the sun's rays. When the sun moves lower to the horizon, the multi-use fasteners can be quickly repositioned.

1 Claim, 8 Drawing Sheets

BOATING ACCESSORY

CROSS REFERENCES TO RELATED APPLICATIONS

This application is a divisional of patent application Ser. No. 17/349,376 filed Jun. 16, 2021, entitled: BOATING ACCESSORY.

FIELD

The present disclosure relates generally to the field of boat accessories and more particularly to a multi-use fastener used to secure a removable shade to various surfaces or structures found on a boat.

BACKGROUND

Open, fishermen class boats are designed with a center console providing an open area layout around the deck with limited obstructions for walking, fishing and participating in other activities while exposed to the sun. Some boats are manufactured with a T-top. T-tops provide shade on a boat by way of a canopy attached to a structural, tubular frame affixed to the deck of a boat. Generally, the canopy of a T-top provides limited shade around the center console of the boat, mostly shading the driver of the boat while leaving others on the boat exposed to the sun.

Presently there are two methods for providing additional shade on a boat: Bimini tops and umbrella-like canopies with a main support and rigging lines. Bimini tops require permanently mounted brackets, additional hardware, tubular frames and a canopy that must be customized to the make, class and layout of each boat. Although some Bimini tops are retractable, they usually have two positions. A fully open position providing shade, and a closed position. Bimini tops require the use of an elaborate frame and anchoring system that must be planned and permanently installed on the boat by drilling, cutting and permanently modifying the boat and the Bimini Top. The elaborate frame and rigging lines of Bimini tops also restrict movement around the boat, making it difficult to walk or stand erect under them. Additionally, such Bimini tops can also restrict one's vision.

Umbrella-like canopies provide adequate shade and are portable but are bulky and have a mounting system that compresses the main support by way of tensioned lines rigged to cleats or other existing hardware on the boat. This restricts the ability of movement and activities around the umbrella and its rigging. The umbrella canopy and rigging must be removed and stowed away prior to shoving off.

Another downside of umbrella canopies and Bimini tops is that the shade provided changes throughout the day as the sun moves through the sky. There is a need for a lightweight, removable boat shade that does not restrict movement and that is easily repositioned depending on the position of the boat and the sun.

SUMMARY

The present disclosure relates to boating accessory that includes a multi-use fastener for securing a removable shade or other objects on or to a boat. In one embodiment, the multi-use fastener includes a body having a first end and a second end; an arm hingedly attached to the first end of the body; a suction mechanism on the second end of the body; and a clip affixed to the arm.

In one embodiment, the multi-use fastener has a notch on an end of the arm configured to secure a cord.

In one embodiment, the multi-use fastener has a rounded portion of the clip.

In one embodiment, the multi-use fastener has a diameter defined by the rounded portion of the clip, the diameter being one-inch.

In one embodiment, the multi-use fastener has a friction element on a tip of the clip for enhanced grip force to various materials or surfaces.

In one embodiment, the multi-use fastener has a cam lever configured to secure the suction mechanism to a flat surface of a boat.

In one embodiment, the multi-use fastener has a locking mechanism, the locking mechanism configured to maintain the arm perpendicular to the body.

In one embodiment, the multi-use fastener includes a ball plunger on the arm and a socket on the body; wherein the ball plunger interfaces with the socket to secure the arm perpendicular to the body.

In another exemplary embodiment, the multi-use fastener has a body having a first end and a second end; an arm having a proximal end and a distal end, the proximal end of the arm hingedly attached to the first end of the body; a suction mechanism on the second end of the body; and a clip affixed on the arm.

In one embodiment, the multi-use fastener has a notch on the distal end of the arm wherein a cord tied to the removable shade is secured in the notch.

In one embodiment, the multi-use fastener has a rounded clip; wherein the rounded clip defines a one-inch diameter opening for securing to a round or tubular structure.

In one embodiment, the multi-use fastener has a cam lever located on the body; and a plunger with a first end connected to the cam lever and a second end secured to the suction mechanism; and the cam lever configured to retract the plunger thereby pulling the suction mechanism to secure the multi-use fastener to a flat surface of a boat.

In one embodiment, the multi-use fastener has a locking mechanism that is configured to maintain the arm perpendicular to the body.

In one embodiment, the multi-use fastener has a ball plunger on the arm; and a socket on the body; wherein the ball plunger interfaces with the socket to secure the arm perpendicular to the body. This ball and socket locking mechanism provides a way to release tension if a burst of force is applied to the boat, the fastener, or to an object to which the fastener is secured.

In another exemplary embodiment, the multi-use fastener for securing a removable shade on a boat includes a body; an arm hingedly connected to the body; a suction mechanism affixed to an end of the body; a rounded clip attached to the arm; a locking mechanism configured to maintain the arm perpendicular to the body.

DETAILED DESCRIPTION OF EXEMPLARY EMBODIMENTS

The present disclosure and accompanying figures presents a Boating Accessory that secures a removable boat shade to various surfaces and structures typically found on boats. The versatility of the Boating Accessory allows the removable shade to be placed in any orientation to create shade on a boat at any time of day. And the Boating Accessory can also be quickly detached and reattached to change the shade or take down the shade in an instant.

Figure 1:
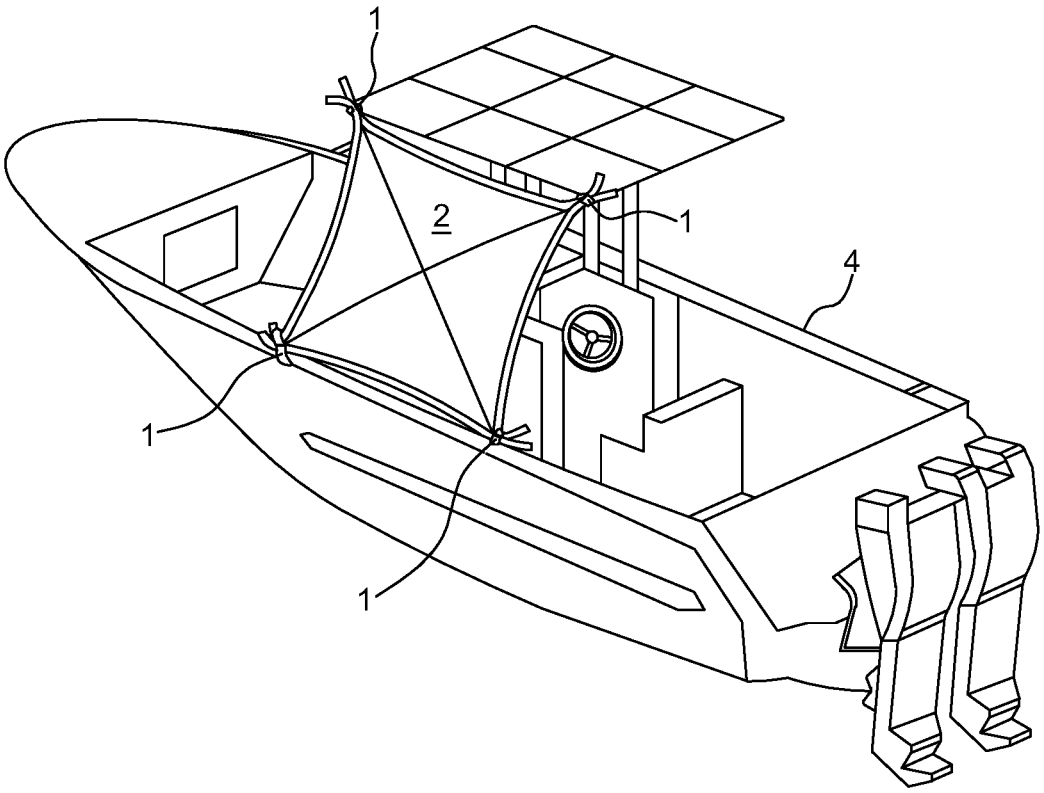
FIG. 1 illustrates the Boating Accessory securing a removable shade to the T-top and side of a boat.

Referring to FIG. 1, four of the Boating Accessories 1 are shown securing a shade 2 to the side of the boat 4 and the T-top of the boat 4. The versatile design of the Boating Accessory 1 can be secured to various surfaces or structures on a boat, such as hand rails, the T-top, or any flat surface. Then, the shade 2 may then be connected to the Boating Accessory 1 to create a shaded area, or expand a shaded area produced by the T-top, on a boat 4 at any time of day.

Figure 2:
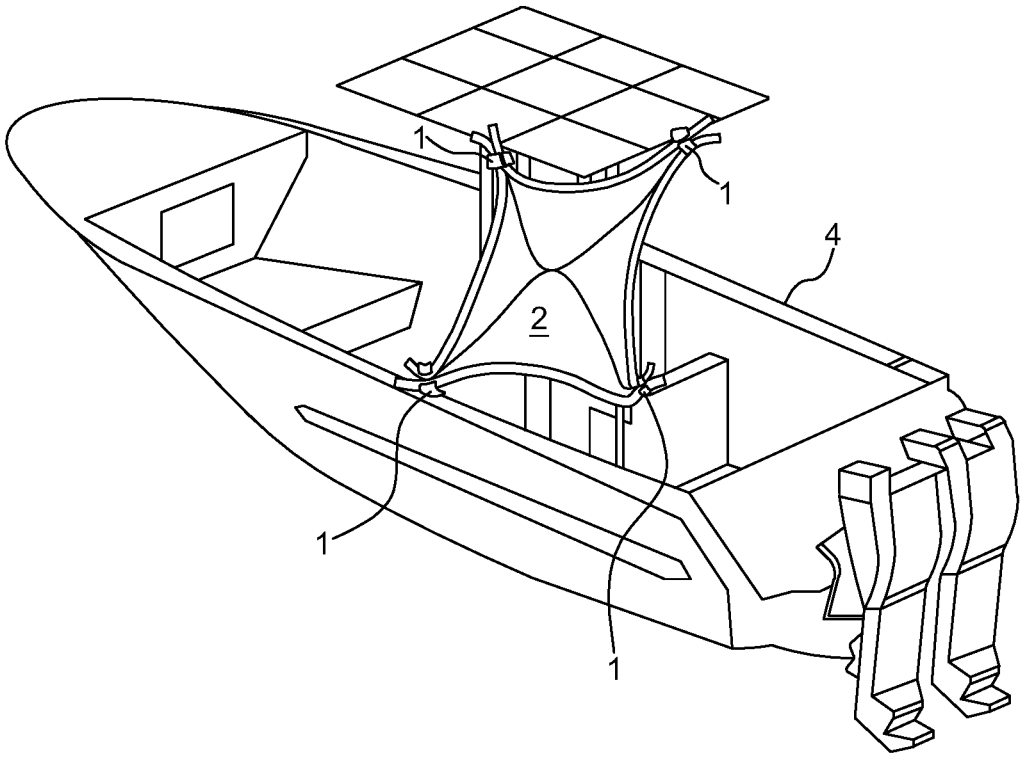
FIG. 2 illustrates the Boating Accessory securing a removable shade in a different position via attachment to different parts of the boat.
Figure 3:
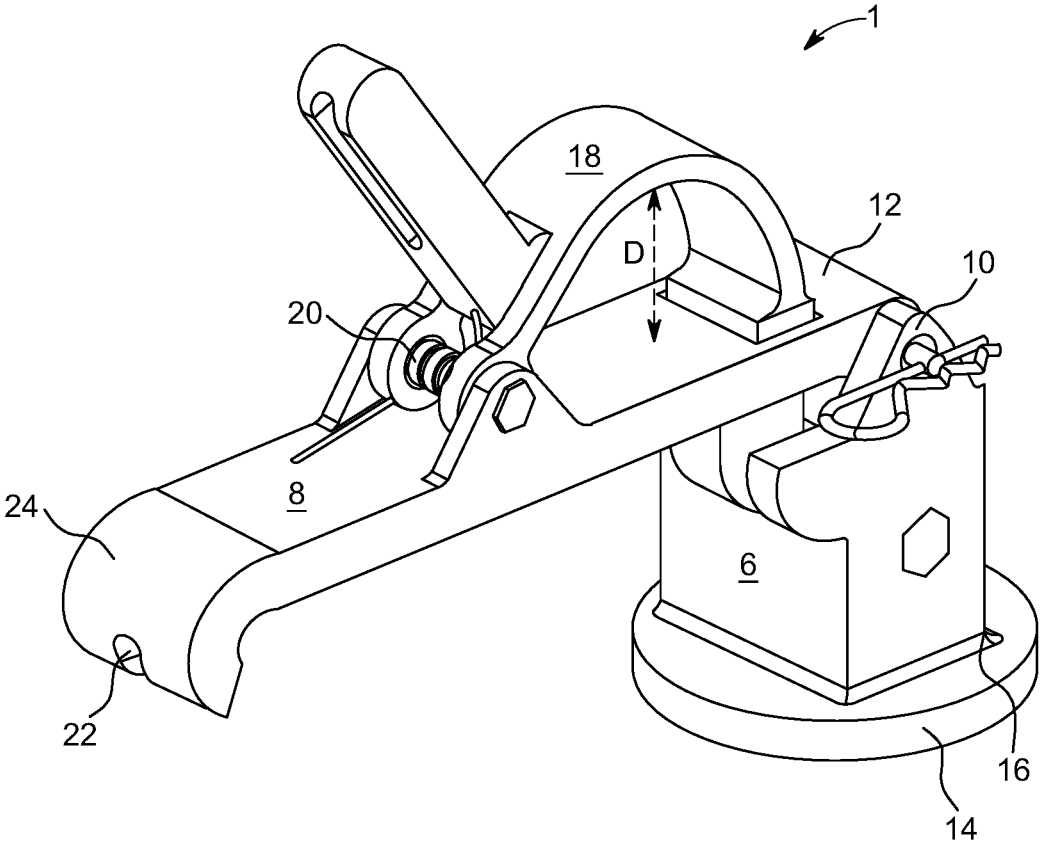
FIG. 3 is a perspective view of an exemplary embodiment of the Boating Accessory.

Referring to FIG. 2, the shade 2 is mounted in a different position on the boat 4 by attaching the Boating Accessories 1 to the T-top, the side, and the seat.

Referring to FIGS. 3 through 6, various views of an exemplary embodiment of the Boating Accessory 1 are shown. In one exemplary embodiment, the Boating Accessory 1 has a body 6 and an arm 8. A first end 10 of the body 6 is hingedly connected to a proximal end 12 of the arm 8. A suction mechanism 14 is located on a second end 16 of the body 6. The suction mechanism 14 allows the Boating Accessory 1 to be mounted on any smooth, flat surface of the boat 4.

In some embodiments, a clip 18 is located on the arm 8. The clip 18 may be configured to secure the Boating Accessory 1 to various structures with different shapes that are found on a boat 4 or to the shade 2. For example, a handrail, the fabric of the T-top, a pole, or a windshield. In some embodiments, the clip 18 may be rounded or include a rounded portion that is configured to clasp around or onto round structures on a boat 4, such as a handrail or the mounting posts of the T-top. In one exemplary embodiment, the clip 18 is hingedly affixed on the arm 8 with a tensioning member 20 that provides a closing force for securing the clip 18 to the shade 2 or a structure on the boat 4.

In some embodiments with a rounded clip 18, the rounded portion of the clip 18 creates a diameter D. The diameter D may be sized to the same diameter as the handrail of the boat 4. By way of example, if a boat has 1-inch diameter handrails, the diameter D may be 1 inch or larger for the clip 18 to fit around the handrail.

Figure 7:
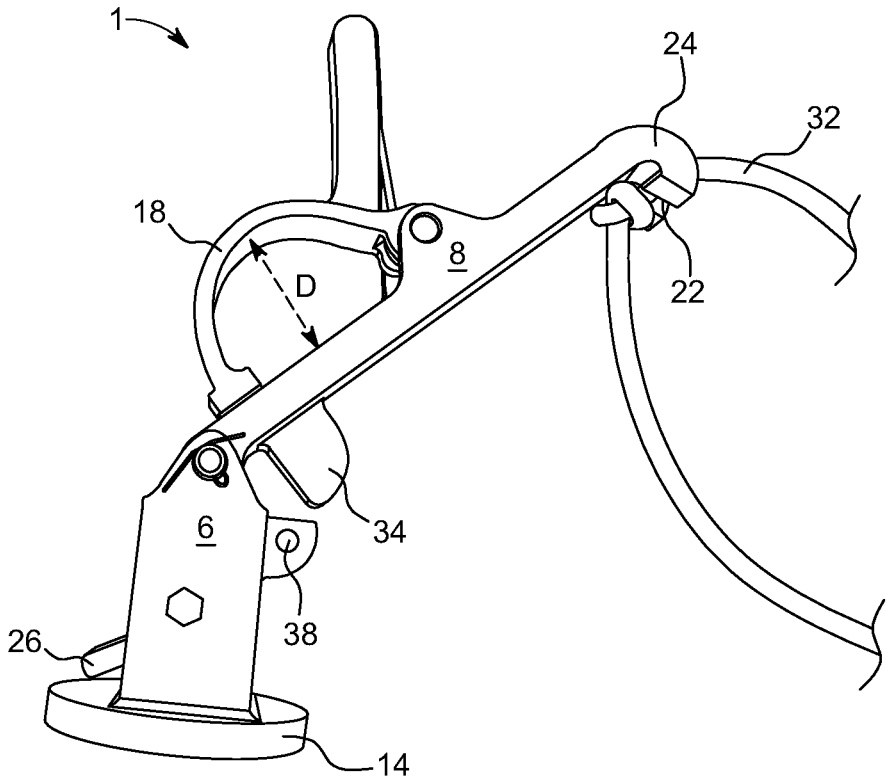
FIG. 7 is a right side view thereof with the arm in an open position.

In some embodiments, a notch 22 is located on a distal end 24 of the arm 8. A rope or cord 32 may be wedged into the notch 24 as shown in FIG. 7. The other end of the cord 32 may be tied to the shade 2 (not shown). The cord 32 may also be tied to another object that needs to be be secured and the Boating Accessory 1 may then be used to ensure that object does not move or fall while the boat is driving.

Figure 4:
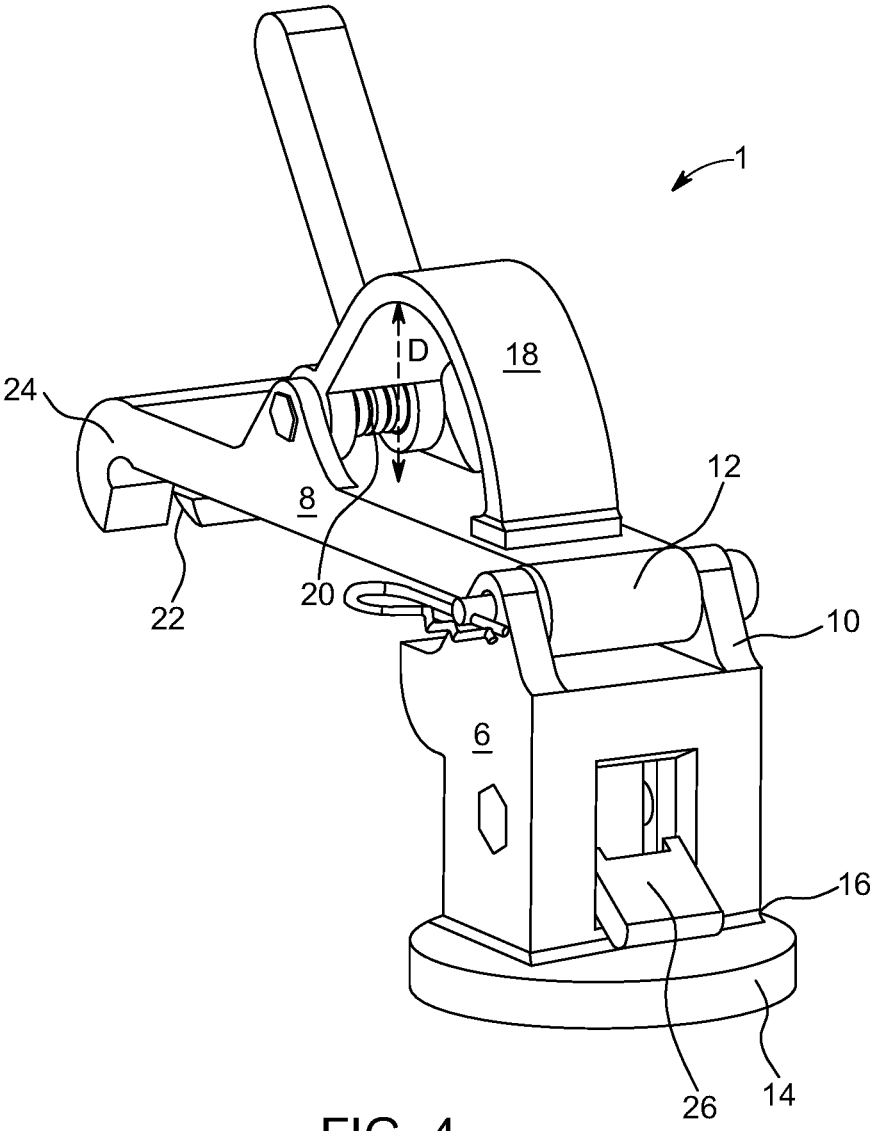
FIG. 4 is a rear perspective view thereof.
Figure 5:
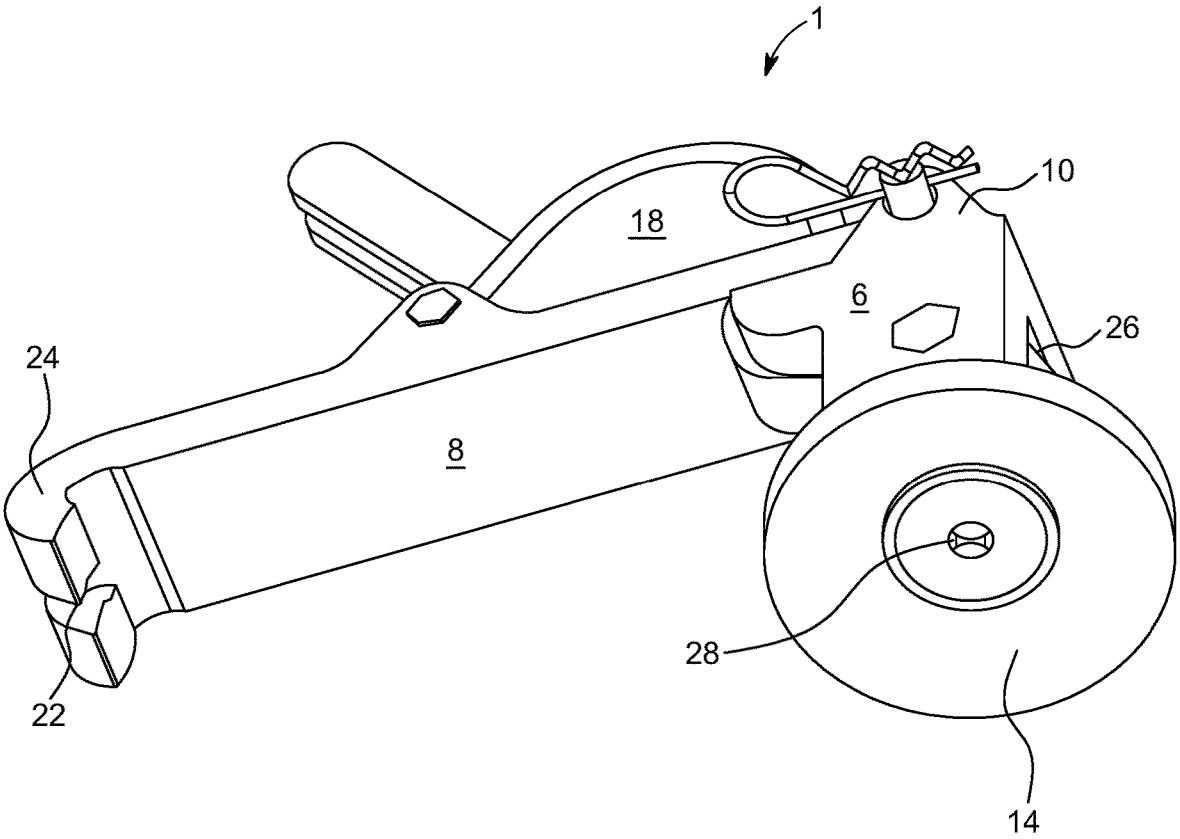
FIG. 5 is a bottom perspective view thereof.

Referring now to FIGS. 4 and 5, the Boating Accessory 1 is shown with a cam lever 26 and plunger 28. In some embodiments, the cam lever 26 is located on the body 6. The cam lever 26 is connected to the plunger 28, and the plunger 30 is connected to the suction mechanism 14. The cam lever 26 is configured to move the plunger 28 drawing the suction mechanism 14 up to secure the suction mechanism 14 to a surface.

By way of example, the clip 18 may be attached onto the shade 2 and the suction mechanism 16 secures the Boating Accessory 1 to a flat surface on the boat 4.

Figure 6:
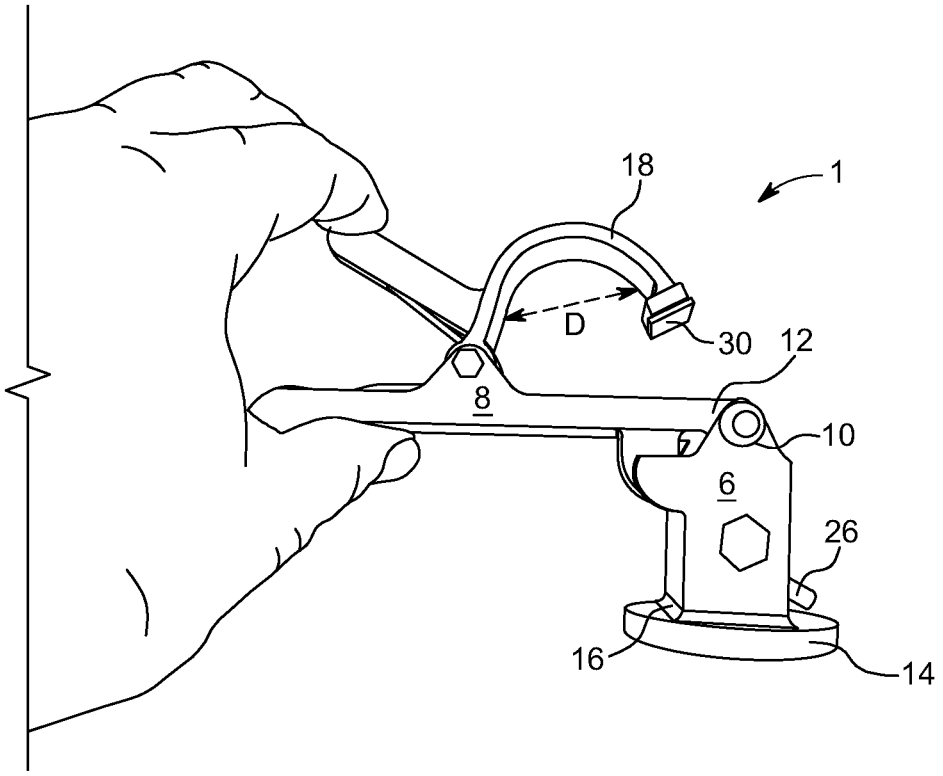
FIG. 6 is a left side view thereof showing a hand opening the clip.

Referring now to FIG. 6, another exemplary embodiment of the Boating Accessory 1 is shown with the clip 18 in an open position. A friction member 30 is located on the tip of the clip 18. The friction member 30 may be rubber or a textured material.

Figure 8:
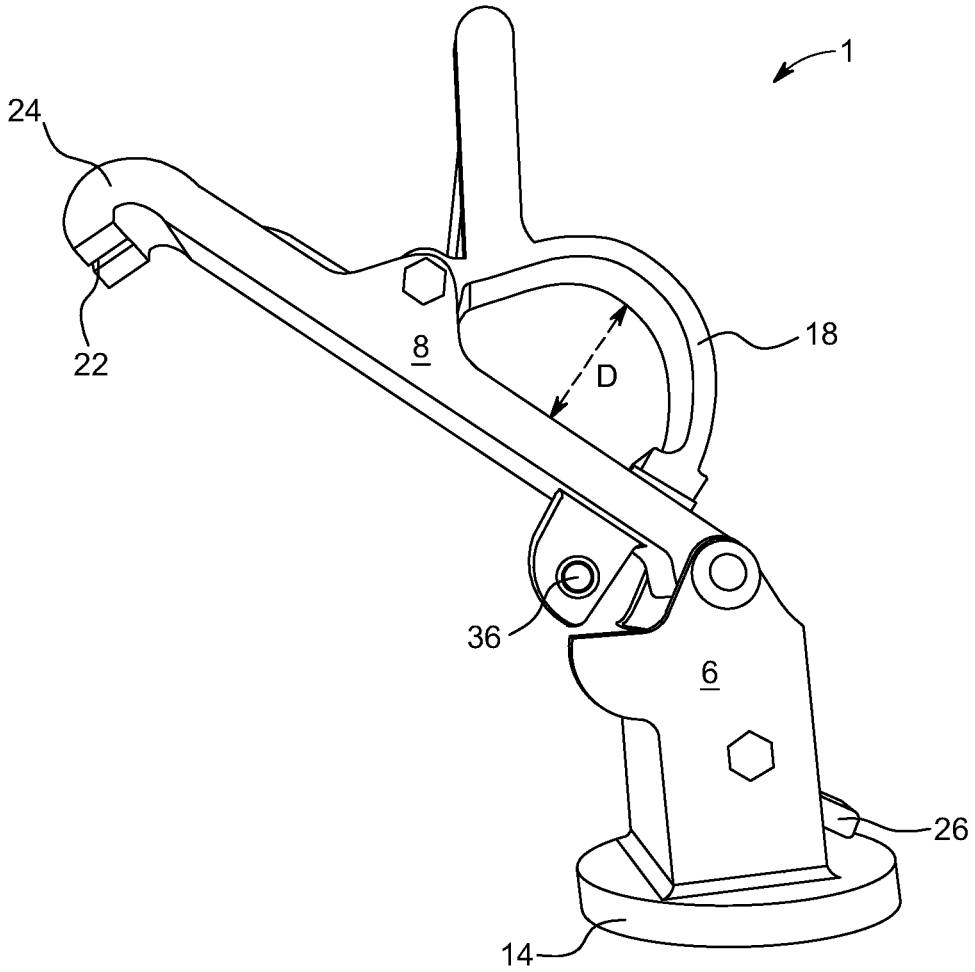
FIG. 8 is a left side view thereof with the arm in an open position.

Referring now to FIGS. 7 and 8, another exemplary embodiment of the Boating Accessory 1 is shown in an open position. In some embodiments, a locking mechanism 34 maintains the arm 8 in a perpendicular orientation to the body 6. The locking mechanism 34 may be a clip, magnet, clasp, or other mechanical piece that holds the arm 8 in place but will disengage or open if an excessive force is applied, such as a gust of wind or a jolt of the boat hull. The locking mechanism 34 helps maintain the desired shade but the disengagement feature protects the shade 2 from tearing or the Boating Accessory 1 from breaking under too much stress.

In one exemplary embodiment, the locking mechanism 34 includes a ball plunger 36 and a socket 38. By way of example, the ball plunger 36 may be located on the arm 8 and the socket 38 located on the body 6. The ball plunger 36 engages with the socket 38 to maintain the arm 8 in a perpendicular position.

Although the inventive concepts of the present disclosure have been described and illustrated with respect to exemplary embodiments thereof, it is not limited to the exemplary embodiments disclosed herein and modifications may be made therein without departing from the scope of the inventive concepts.

What is claim is:

1. A boating accessory for securing a removable shade on a boat comprising:

a body having a first end and a second end, an arm hingedly attached to the first end of the body, a notch on an end of the arm configured to secure a cord, the cord is connected to the removable shade, a suction mechanism on the second end of the body. the suction mechanism is secured to the boat, and a clip affixed to the arm and the clip is affixed to the removable shade of the boat.

* * * * *